US005793158A

United States Patent [19]

Wedding, Sr.

[11] Patent Number: 5,793,158

[45] Date of Patent: Aug. 11, 1998

[54] GAS DISCHARGE (PLASMA) DISPLAYS

[76] Inventor: Donald K. Wedding, Sr., 4533 Wedgewood Ct., Toledo, Ohio 43615

[21] Appl. No.: 864,896

[22] Filed: May 29, 1997

Related U.S. Application Data

[63] Continuation of Ser. No. 978,221, Nov. 19, 1992, abandoned, which is a continuation-in-part of Ser. No. 932,199, Aug. 21, 1992, abandoned.

[51] Int. Cl.[6] ..... H01J 61/42

[52] U.S. Cl. ..... 313/493; 313/489

[58] Field of Search ..... 313/493, 489, 313/484, 587, 485

[56] References Cited

U.S. PATENT DOCUMENTS

| | | | |
|---|---|---|---|
| 3,814,970 | 6/1974 | Reboul | 313/587 |
| 3,932,783 | 1/1976 | Menelly et al. | 313/485 |
| 3,934,172 | 1/1976 | Okamoto | 313/485 |
| 4,224,553 | 9/1980 | Hellwig | 313/489 |
| 4,325,002 | 4/1982 | Kobale et al. | 313/493 |
| 4,429,303 | 1/1984 | Aboelfotoh | 313/485 |
| 4,692,662 | 9/1987 | Wada et al. | 313/493 |
| 4,827,186 | 5/1989 | Knauer et al. | 313/485 |
| 5,086,297 | 2/1992 | Miyake et al. | 313/485 |

*Primary Examiner*—Sandra L. O'Shea
*Assistant Examiner*—Vip Patel
*Attorney, Agent, or Firm*—Jim Zeeger, Esq.

[57] ABSTRACT

A gas discharge display panel incorporating phosphor protected by undercoats and overcoats. The device is comprised of a pair of substrates, each of which has an electrode array thereon with the dielectric coating on at least one of the electrode arrays. An array of channels having sidewalls is formed in the dielectric layer with an array of channels corresponding to and aligned with one of the electrode arrays. The channels have sidewalls and lands between channels with a protective undercoat on the channel sidewalls and a photoluminescent phosphor on the protective undercoat. Due to the sloping nature of the sidewalls and the photoluminescent phosphors being sandwiched between the protective undercoat and overcoat and the channel walls in which the phosphor is placed outside the path of charged particles produced on discharge but close or near the site of the UV production, the arrangement significantly enhances the light output because the phosphor surfaces are greater in extent area wise and are closer to the UV sources in the discharge and are not in the path of the discharge products. Since the light is produced in two spaced areas of phosphor by the UV produced on discharge, more light is produced and electrodes have less attenuating effect on visible light emission from each side.

10 Claims, 5 Drawing Sheets

GAS DISCHARGE (PLASMA) DISPLAYS

This application is a continuation of application Ser. No. 07/978,221, filed Nov. 19, 1992, abandoned, which in turn is a continuation-in-part of application Ser. No. 07/932,199 filed Aug. 21, 1992, abandoned.

BACKGROUND OF THE INVENTION

This invention relates to gas discharge (plasma) displays, and more particularly to color gas discharge display panels.

Multiple cell gas discharge display and/or memory panels of one particular type with which the present invention is concerned are characterized by an ionizable gaseous medium, at an appropriate gas pressure, in a thin gas chamber or space between a pair of opposed dielectric charge storage members. The dielectric charge storage members are typically backed by arrays of electrodes or conductors which are appropriately oriented so as to define a plurality of discrete gas discharge unit or cell sites.

In some embodiments, the discharge cells are additionally defined by surrounding or confining physical structures such as apertures in perforated glass plates and the like so as to be physically isolated relative to other cells.

In either case, with or without the confining physical structure, electronic charges are produced upon the ionization of the gas volume at a selected discharge cell, when proper alternating operating potentials are applied to selected electrodes or conductors thereof. The electronic charges are collected upon and/or within the dielectric at specific locations defined by the cross-overs of opposite electrodes. These charges constitute an electrical field opposing the electrical field which created them so as to terminate the gas discharge for the remainder of the half cycle and aid in the initiation of a gas discharge on a succeeding opposite half cycle of applied voltage. Such dielectric charges as are stored constitute an electrical memory.

The dielectric members prevent the passage of substantial conductive current from the conductor members to the gaseous medium and also serve to collect or store ionized gaseous medium charges during the cycles of the operating potentials. Such charges collect first at one elemental or discrete dielectric surface area and then at an opposing elemental or discrete dielectric surface area on alternate half cycles to constitute the electrical memory.

An example of a panel structure containing nonphysically isolated or open discharge cells is disclosed in U.S. Pat. No. 3,499,167 (incorporated herein by reference) issued to Baker, et al.

An example of a panel containing physically isolated cells is disclosed in U.S. Pat. No. 3,559,190 (incorporated herein by reference) issued to Bitzer, et al.

A monolithic or single substrate device structure may also be used as disclosed in U.S. Pat. Nos. 3,860,846 (Mayer), 3,964,050 (Mayer), 4,080,597 (Mayer), 3,646,384 (Lay) and 3,896,327 (Schermerhorn), all incorporated herein by reference.

In the construction of the panel, a continuous volume of ionizable gas is confined between a pair of dielectric surfaces backed by electrode arrays typically forming matrix elements locating individual pixels in the display. The two electrode arrays may be orthogonally related sets of parallel lines. However, any other configuration of electrodes may be used. The two arrays of electrodes define at their crossovers a plurality of opposed pairs of charge storage areas on the opposing surfaces of the dielectric members bonding or confining the gas. Thus, for a first array of R parallel row electrodes and a second array of C parallel column electrodes, the number of gas discharge cells will be the multiple of R times C. The number of dielectric charge storage locations will be twice the number of discharge cells where the electrodes of each array are separated from the gas by a dielectric member.

It is possible to have only one electrode array insulated from the gas with a dielectric member and have the other opposing electrode array in direct contact with the gas, or coupled to the gas through a resistive layer.

In one monolithic panel structure, a first dielectric layer is applied over a first array of X-electrodes and a second array of Y-electrodes is applied over the first dielectric layer. A second dielectric layer is then applied over the second array of Y-electrodes. A top envelope portion is applied over the substrate and filled with ionizable gas such that a chamber of gas is above the second dielectric layer.

In the monolithic device structure, the dielectric applied over the bottom X-electrodes must be capable of physically, mechanically and structurally supporting the array of top Y-electrodes applied over the first dielectric portion without flexure or movement of the electrodes. Such dielectric support of the Y-electrodes is especially important during the various process thermal cycles. Thus, it is important that the supporting dielectric portion not become soft and flow or develop cracks or flaws during the application of the Y-electrode or during the application of a second dielectric portion covering the Y-electrodes or during the sealing together of the envelope and substrate.

Bitzer et al. U.S. Pat. No. 3,559,190, referred to above, discloses an AC plasma display with a multiplicity of physically isolated cells with phosphor deposited on the walls of the cells. Baker et al. U.S. Pat. No. 3,499,167, referred to above, discloses an AC plasma display having "open" cell structures, one embodiment of which includes an array of grooves, channels or troughs aligned with an array of dielectric covered electrode array. Schermerhorn U.S. Pat. No. 3,896,327 discloses an AC plasma display having a common substrate for the dielectrically covered electrode arrays and cavities in the dielectric for the discharge sites to form a so-called "monolithic" display panel.

Knauer et al. U.S. Pat. No. 4,827,186 discloses an alternating current plasma display panel (AC-PDP) in which an etched or chemically milled imperforate barrier structure has upstanding posts with cell sidewalls defining concavities intermediate the posts. The imperforate structure has a plurality of such concavities, each associated with a unique cell and providing an intercell barrier structure. The cell sidewalls are provided with priming particle passing gaps and UV responsive phosphor islands are deposited on the surface of a front dielectric structure.

In contrast, in the present invention, elongated channels, troughs or grooves are chemically milled in the dielectric layers, and the channels, troughs, or grooves have elongated ribs or lands therebetween. The sloping rib walls are coated with a phosphor structure (undercoat/phosphor/overcoat) which significantly enhances the light output because the phosphor surfaces are greater in extent area-wise, closer to the UV sources in the discharge and are not in the path of discharge products. Since light is produced in two spaced areas of phosphor by the UV produced on discharge, more light is produced and the electrodes have less attenuating effect on visible light emission from each side. Moreover, since the channels, troughs or grooves, in a preferred embodiment, are formed in a second (and even a third) dielectric layer, the seal area or zone (for securing a second electrode bearing substrate to form the matrix) can be on the first dielectric layer with the ends of the channels, troughs or grooves formed in the second (and even third) dielectric layer being in free connection via a transition corridor for exemplary or ideal vacuum bake-out operations with the transition corridor serving as the site for border conditioning discharge sites.

SUMMARY OF MANUFACTURING PROCESS

In the overall practice of this invention, the manufacturing process comprises:

a. applying an array of electrodes to a first substrate and an array of electrodes to a second substrate;

b. applying at least one layer of a dielectric material over the array of electrodes on the first substrate and at least one layer of dielectric material over the array of electrodes on the second substrate;

c. forming in the dielectric layer of the first substrate a multiplicity of ribs or barriers forming grooves, channels or troughs aligned with one of the electrode arrays;

d. applying at least one layer of a protective undercoat over the dielectric including the formed grooves, channels or troughs of the first substrate;

e. applying phosphor within the grooves, channels or troughs of the first substrate;

f. applying at least one layer of protective overcoat over the dielectric, protective undercoat, and phosphor of the first substrate;

g. positioning the dielectric face of the second substrate over the dielectric grooves, channels or troughs of the first substrate, the array of electrodes on the second substrate being appropriately oriented relative to the array of electrodes on the first substrate so as to define a plurality of discrete gas discharge units or cell sites;

h. sealing the two substrates together;

i. and filling the grooves, channels or troughs with an ionizable gas.

DESCRIPTION OF THE DRAWINGS

The above and other objects, advantages and features of the invention will become more apparent when considered with the following specification and accompanying drawings wherein.

Figure 1A:
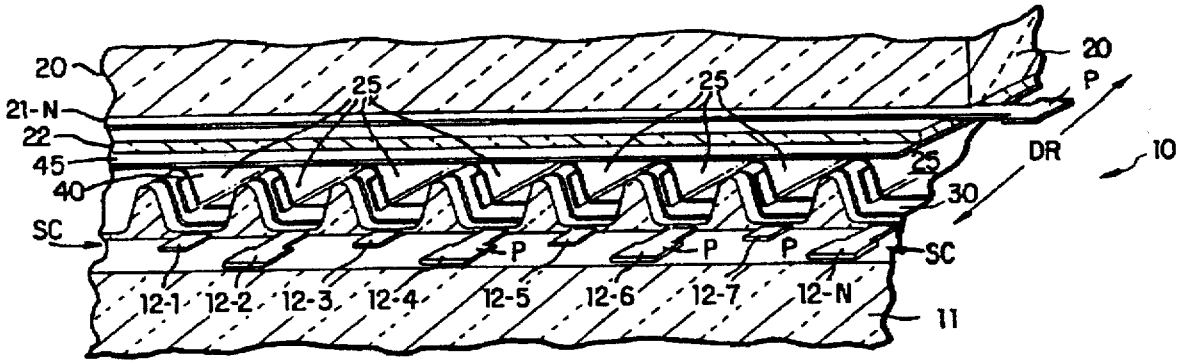
FIG. 1A is an isometric perspective view of an AC plasma color display panel incorporating the invention with various layers and components removed to reveal the physical construction.

DETAILED DESCRIPTION OF THE INVENTION:

In the isometric perspective view shown in FIG. 1A, a display panel 10 incorporating the invention has a first substrate 11, typically a glass or ceramic substrate, has a first electrode array 12-1, 12-2, 12-3 . . . 12-N formed thereon. (As described more fully hereafter, electrode arrays are preferably gold on a tantalum base). In order to provide rooms for attachment or connection pads P, alternate electrodes (odd/even) extend to the opposite edge of the substrate. Electrode array 12-1, 12-2 . . . 12-N is coated with dielectric layers to form two regions, a seal transition corridor or region SC best seen in FIG. 1C and a display region DR. In FIG. 1A, the seal region or corridor SC is not shown in the illustration. The seal transition corridor or region SC has a thin dielectric coating 19 on electrode array 12-1, 12-2 . . . 12-N.

Viewing side substrate 20 is transparent and carries electrode array 21-1, 21-2 . . . 21-N and a thin dielectric coating 22 which is uniformly applied thereover and both dielectric coatings 19 and 22 can have one or more protective overcoats applied as will be described hereafter. A glass seal frame member 24 is fusibly sealed to the surfaces of dielectric coatings or layers 19 and 22 to form a vacuum backable hermetic enclosure.

The dielectric on substrate 11 which is in the display region DR has formed therein an array of discharge gas filled grooves, channels or troughs 25 separated by ribs or lands 26. As described more fully in connection with the manufacturing process, the dielectric in the display region DR is preferably applied in several layers or applications, so as to achieve uniformity and thickness sufficient to form the array of grooves, channel or troughs 25 separated by ribs or land 26. One or more of the dielectric layers may include a black colorant so that the later applied phosphor strips or dots have a black background or surround. Preferably, the grooves, channels or troughs 25 are formed by chemical milling processes described later herein. The edge of the display region (e.g., where the grooves, channels or troughs 25 and ribs 26 end or terminate, is spaced from the inside edge of seal member 24 a short distance). This allows the vacuum bake out and discharge gas filling, through gas fill tubulation 28, to take place in all of the grooves, channels or troughs 25 uniformly. Moreover, one or more columns or rows of border discharge sites between one or more border electrodes 27 and the electrodes in electrode array 12-1, 12-2 . . . 12-N for conditioning purposes can be provided in this area and, preferably, masked from view. It is common practice to provide such border discharge sites to provide conditioning of discharge sites in the display region DR for discharge at more uniform operating potentials. Thus, the transition or seal corridor serves three basic functions: seal area, vacuum bake-out and discharge gas fill corridor and for conditioning purposes to assure more uniform operating potentials at each discharge site. In addition, or as an alternative, conditioning can be provided by edge discharges in the grooves, channels or troughs 25 and such conditioning discharge sites likewise masked from view.

Figure 1B:
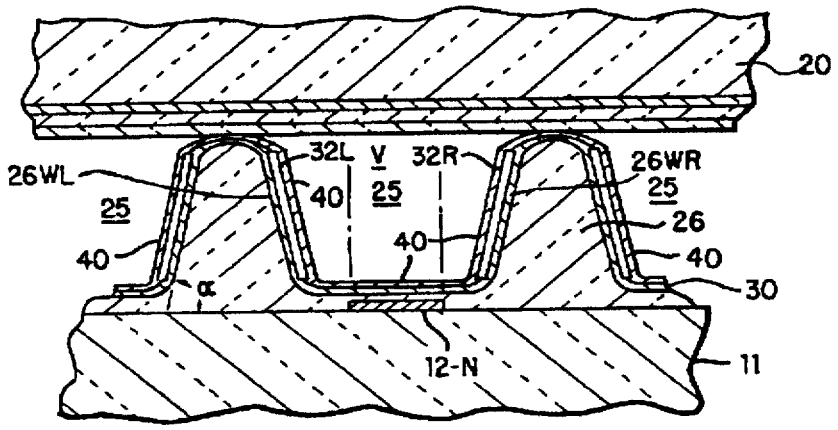
FIG. 1B is a greatly enlarged diagrammatic sectional view through one discharge site of an AC plasma color display panel incorporating the invention.
Figure 1C:
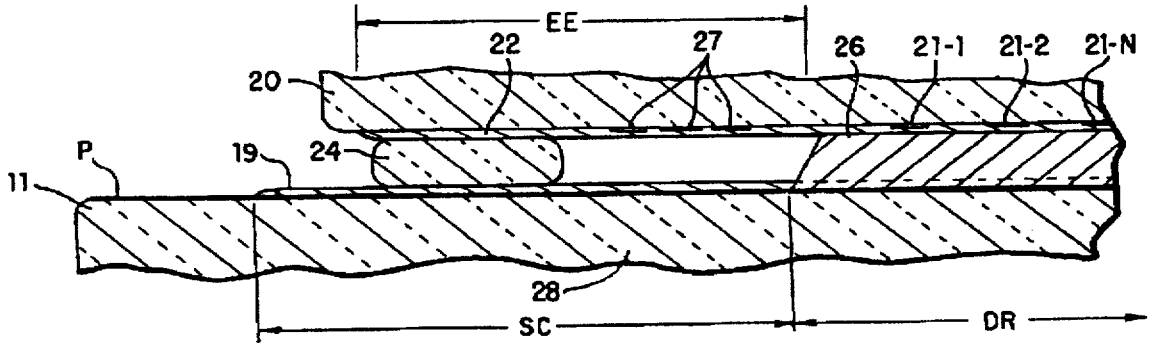
FIG. 1C is a greatly enlarged diagrammatic view through the seal/transition corridor area of the panel shown in FIGS. 1A and 1B.

The construction of display region DR is best seen in FIGS. 1A and 1B. After formation of the grooves, channels or troughs 25 in the dielectric in the display region, undercoat 30 is applied in one or more continuous layers. Undercoat 30 provides a protective base for UV responsive phosphors (photoluminescent) on the two sidewalls of the barrier ribs or lands 26 forming each channel or groove 25. In the case of a color plasma display, each channel or groove will have two curved walls facing each other carrying Uw responsive phosphor of a selected color emissivity. If, for example, the channel or groove 25 aligned with electrode 12-N was designated to be "blue", the two opposed wall surfaces 26WL and 26WR or ribs or barriers 26 would have blue phosphor stripes 32L and 32R applied over the continuous undercoat layer 30. Surfaces in the discharge spaces or volume V between electrode 12N and the opposing electrodes on viewing substrate 20 are preferably free of phosphor so as to not interfere with the discharge or memory characteristics of the discharge site. From the viewing side, the light emitted by phosphor on the two sloping sidewalls is additive and tend to provide a brighter color display. The particles of phosphor on the sloping surfaces can be thought of as individual sources which, due to the slope, have a stacked vertical component of light produced.

Advantageously, surfaces of phosphor layers 32L and 32R face upwards and are on the optical isolation barriers constituted by ribs or barriers 26 and the walls 26WL and 26WR are at an angle to the plane of the substrate except at the bottom of the channel or groove. The slope ($\alpha$) of the rib wall should not affect the discharge itself. The slope will determine total surface area available for phosphor deposition, i.e., more curved, more surface area for deposition of phosphor. The more phosphor particles, more surface area of phosphor particles is available for UV conversion, and hence, a higher efficiency of UV conversion. A sloped wall gives a slightly better viewing angle but the main point is the discharge gap. A smaller gap results in a better viewing angle. Since smaller gap is for higher resolution displays, a higher resolution provides a better viewing angle.

The two phosphor stripes are simultaneously activated by the UV emission during any discharge and while there are two sources of visible light production (one from each phosphor) and because the spacing between the two phosphor stripes is small, and because light is also reflected off of the reflective mirror-like surface of the gold electrode 12N, the luminous efficiency is enhanced. The surfaces of the phosphor impinged by UV is caused to emit light and that surface is viewed directly through the viewing substrate. This is in contrast to those systems where the phosphor is on the viewing substrate so that light travels through the phosphor. Moreover, in a color display, since each individual cross-point defines a color pixel (blue, green or red) which can be selectively controlled to produce a large number of levels of gray intensity levels, (e.g., brightness levels ranging from a maximum to a minimum) and, accordingly, a large palette of colors by different permutations of these colors and color intensity level. Moreover, in directions transverse of the direction of the channels, grooves or troughs 25, there is no optical cross-talk between adjacent sites because of the barriers 26. There is no optical isolation between adjacent sites along each channel because they are of the same color and cross-talk effects, if any, can be minimized by optionally providing a somewhat larger spacing between electrodes 21-1, 21-2 . . . 21-N.

The facing surfaces 26WL and 26WR of the ribs carrying phosphor layers or stripes 32L and 32R are sloped and at an angle $\alpha$ relative to the substrate 11. It is desirable to provide a flat valley in groove, trough or channel 25, over the electrode aligned with groove, trough or channel. The chemical milling process described later herein can be controlled to generally control the angle $\alpha$ and provide a substantially flat dielectric valley over the electrodes.

As described later herein, the three photoluminescent phosphors are applied in stages for a full color embodiment, a separate stage for each phosphor. For a monochrome white embodiment, a single application of premixed red, green and blue phosphors in the right proportions would occur. After the phosphors have been applied, a continuous protective overcoat 40 is applied over the entire surface of the phosphor stripes 32L, 32R and the undercoat 30. The overcoat 40 protects the dielectric surfaces over the electrodes from deterioration due to ion bombardment, sputtering, etc., and also is of a material which has excellent secondary electron emissivity for conditioning purposes. The phosphor layers are protectively sandwiched between the continuous undercoat layer 30 and the continuous overcoat layer 40 and, since the phosphors are not in line with the path of electron and ion travel from discharge between the rear and front electrodes, there is substantially no deterioration in the phosphors leading to long life and constant phosphor efficiency and constant light output. Since the overcoat layers are relatively very thin, they are essentially transparent to most of the UV radiation which is to be converted to visible light by the UV responsive phosphors, and at the same time, since the overcoat is of a material which is a good secondary electron emitter, the individual sites are conditioned for operation at more uniform operating potentials.

Moreover, for color plasma displays, the discharge gas medium discussed below is selected to be rich in deep UV emission, inter alia, and preferably, does not produce visible light so as to interfere with the visible light output of the phosphor. Since the phosphor bearing sidewalls 26WL and 26WR are relatively near the source of UV in volumetric space V, the UV has to travel a relatively short distance from the point where the UV is created to the point of impact on the phosphors at each side of the discharge volume V. Thus, the combination of the double phosphor stripes for each discharge site, the nearness of the phosphor to the source of UV (and yet outside the area of phosphor deterioration due to ion bombardment), the protective undercoat and protective overcoat stabilizing and maintaining the phosphor, the mirror-reflective gold electrode and the additive slope angle $\alpha$ of walls 26WL and 26WR bearing the phosphor provide bright colors with high intensity, stable operations and long display life.

The viewing side of display panel 10 includes transparent support substrate 20, electrode array 21-1, 21-2 . . . 21-N, covered by a dielectric layer 22, which has one or more protective continuous overcoats 45. Border electrodes 27 are positioned in the area of the edge extension EE, which overlies a portion of the transition corridor SC. While the dielectric thicknesses (including overcoats) and discharge gap between border electrodes 27 and the ends of electrodes in array 12-1, 12-2 . . . 12-N are essentially the same, so that write, erase and sustain potentials are essentially the same, in some cases it may be desirable that they be different. This can be achieved by selectively varying the dielectric thickness in the border discharge site area.

Figure 1D:
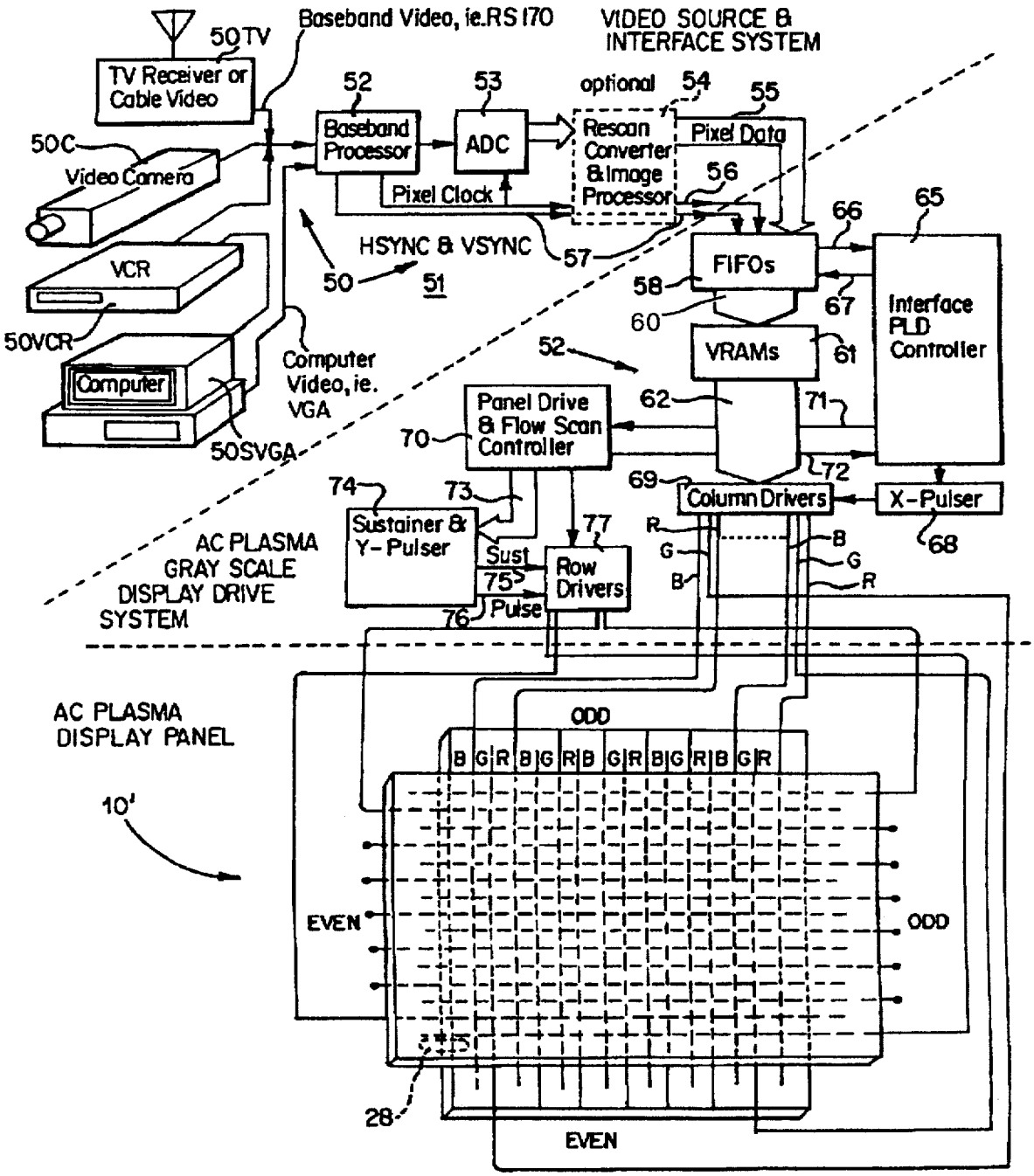
FIG. 1D is a block diagram of a color gas discharge system incorporating the invention including multi-media interfacing, gray scale and a color AC plasma display panel.

FIG. 1D is a block diagram of AC plasma display systems wherein one of a variety of video data sources such as television 50TV, tape recorder 50VCR, video camera 50C, computer 50SVGA, etc. is coupled by interface system 51 to a gray scale processing system 52 and thence to AC plasma color display panel 10' which can be constructed in a high definition television (HDTV) format.

Digitized video from a video source 50 (above the dashline) is presented to the drive system 51 (below the dashline) as a byte serial stream of pixel data on data bus 55. In an exemplary embodiment of the invention as disclosed herein, a byte is defined as 6 to 8 bits which represent at least 64 levels of gray scale for each pixel within each color channel. In FIG. 1D is shown the functional diagram of the drive system 51 along with the functional diagram of the video source and interface system 50. The architecture of drive system 51 will accept 7 and 8 bit bytes for 128 and 256 levels of gray for each pixel where faster gas (non-neon) plasma panels are used, particularly those gases which are rich in UV production.

As noted above, the video source system 50 may contain a computer 50SVGK with VGA or SVGA or similar type of digitized video output capability. The video source may also contain a camera 50TV, VCR 50VCR or TV receiver 50TV, or could also contain a combination of the above. In any case, the video source and interface system will employ a digitizer which provides the pixel byte stream into drive system 51. The digitizer comprises baseband processor 52 and analog-to-digital converter 53 (ADC). The video source system 50 may also incorporate rescan conversion and/or image processing circuit 54 to adjust gray scale values for global brightness offsets, for dithering techniques, or for non-linear gray scales. The digitizer and/or rescan converter may also include "window" portion necessary to show on smaller screens, etc. The digitizer and rescan converter can contain circuitry, including memory to selectively capture and resynchronize video images and/or video graphics. The baseband processor could also incorporate multisynchronizing capabilities such as exist on many available SVGA-type of monitors today. In any case, the digitizer and rescan converter could allow the capability, for example, to capture a 512×512 or 480×640 portion from a 768×1024 or HDTV format for the overall image. The selected image may then be resynchronized and transferred into the invention's drive system for display. It is also possible that a smaller physical image could be captured and resynchronized; and then displayed by the invention in a selected portion of a bigger matrix image.

The front end FIFOs 60 contribute to the averaging or smoothing of data rate in synchronization with the digitizer 53. This smoothing of the incoming data rate together with capturing a selected portion of image frames is further discussed below in connection with the operation of the FIFOs and VRAMs.

The digitizer 53 is a necessary part of an overall display system in which the invention's drive system 51 is employed. In addition to providing the pixel byte stream, the digitizer 52, 53 must provide horizontal and vertical sync 57, and pixel clock 58. The invention provides for a timing scheme which allows even and odd frames to be discerned and appropriately processed according to the logic state of horizontal sync at the time of vertical sync deactivation.

GRAY SCALE

The total number of available colors which can be emitted by a gas discharge display is determined by the number of primary colors and the number of levels or bits of gray scale. For example, with three primary colors (red, green, blue) and two levels (one bit) or gray scale, the number of possible colors is 2×2×2, or 8. For three primary colors and 64 levels (6 bits or $2^6$), the number of colors is 64 for each primary color or 64×64×64 for three primary colors, a total of 262,144 colors.

A number of techniques have been disclosed in the prior art for gray scale operation of a gas discharge device. For example, these include spatial gray scale as disclosed in Schmersal et al. U.S. Pat. No. 3,845,243; time modulation of bistable states as disclosed in Schmersal U.S. Pat. No. 3,863,023; ordered dither; and various geometric arrangements such as stacked panels.

Gray scale may also be accomplished by the operation of an AC plasma panel in a non-memory or non-bistable mode as disclosed in Nolan U.S. Pat. No. 4,002,828 and Ryan U.S. Pat. No. 4,067,047.

Gray scale may also be accomplished by the technique disclosed in Fowler et al. U.S. Pat. No. 4,006,298.

In the best mode of this invention, the color display uses a gray scale with time modulation.

FIG. 1D illustrates the functional and schematic diagram for the high density memory architecture in the drive system 51. Directly receiving the pixel byte stream are FIFOs 58 which accept the bytes on the input and convert the pixel bytes into serial bits at the FIFO outputs 59. The serial bit outputs from the FIFOs are tied to the serial inputs of VRAMs 61 as shown in FIG. 1D.

In the gray scale drive system shown in FIG. 1D, the high density memory architecture is centered on the serial throughput of pixel data from FIFOs 58 to the inputs of VRAM 60. The VRAMs 60 are normally used to accept data in parallel and then output the data to video conversion circuits in serial. However, for the high speed serialized data from the FIFOs, the parallel inputs to the VRAMs are not fast enough. An architecture with SRAMs could be used to allow fast parallel accessing of pixel data through RAM, but significant dual porting control and multiplexing would be required as additional architecture functions; and SRAMs have only about 25% to 50% of the memory density of VRAMs, as well as a higher cost per bit. Hence, the VRAMs are utilized in the preferred embodiment.

A typical VRAM circuitry is disclosed in Toshiba Technical Data, TC 528126/AP/AJ-2, 1986-6-1, incorporated herein by reference. Separate I/O ports are provided for parallel and serial accessing of the VRAMs interval cell arrays. The parallel accessing occurs through combined row/column addressing while the serial accessing occurs through a starting column address and serial address counter. The serial address counter operates independently from the addressing except when preset with a starting column address. The serial I/O port stores transfer information in a serial access memory (SAM) which buffers column accesses to/from the internal cell array.

The VRAMs have built-in dual porting control and multiplexing by shifting into the VRAMs shift register and uploading to the RAM, instead of parallel accessing the VRAM and downloading into their shifting registers (and subsequently into the driver shift registers) pixel data is moved through the VRAM buffer sufficiently fast for the preset invention's requirements.

Pixel data bus 55, pixel clock on clock bus 56, and horizontal sync and vertical sync on sync bus 57 are supplied to the display drive system 51 to AC plasma panel 10 via the high density memory architecture centered on the serial throughput of pixel data from FIFOs 58 to the VRAMs 61, thence via column driver bus 62 to the column driver 69, and column (X) conductors or electrodes 12 on the AC plasma panel 10. Interface controller 65 is a programmed logic device (PLD). Controller 65 receives the pixel clock data and horizontal sync and vertical sync signals on line 66 and issues FIFO control signals on line 67. Interface controller 65 also supplies signals to column or X pulse circuit 68 which supplies the column driver 69. In addition, interface controller 65 is programmed to control panel drive and row scan controller 70 via lines 71 and line 72. Panel drive and row scan controller 70 via bus 73 causes sustainer and row or Y-pulser 74 to issue sustainer drive signals 75 and pulse drive signals on line 76 to row driver circuits 77 which are coupled to the row conductors or electrodes 78 on AC plasma panel 10.

In the preferred embodiment, each display site has an "on" state characterized by the presence of wall voltage on the dielectric surfaces at electrode crossings, and an "off" state characterized by the absence of wall voltage. The gray scale drive system shown in FIG. 1D is controlled to supply write, erase, and sustaining potentials to the electrode arrays, in what can be called burst addressing, as follows: 1) the write potential is supplied to all the electrodes to cause all display sites or pixels to be in an "on" state, 2) the erase potential is applied to selected ones of the electrodes in the arrays to erase selected ones of the display sites or pixels and cause the selected ones to be in an "off" state, and finally, 3) a burst of sustaining potentials is supplied to the electrode arrays for predetermined number of cycles to cause the display sites or pixels in the "on" state to emit light for each sustainer cycle. Operations 1, 2 and 3 are repeated a predetermined number of times to define a frame and varying the number of sustain cycles in each succeeding repetition of operation 3 for each frame according to the gray scale level desired for each display sites or pixels in the "on" state. Burst addressing for gray scale purposes provides the following advantages: 1) artifact reduction, 2) non-linear gray levels, 3) better energy recovery, 4) global dimming, and 5) because of faster scanning, the display is brighter.

MANUFACTURING PROCESS

Figure 3:
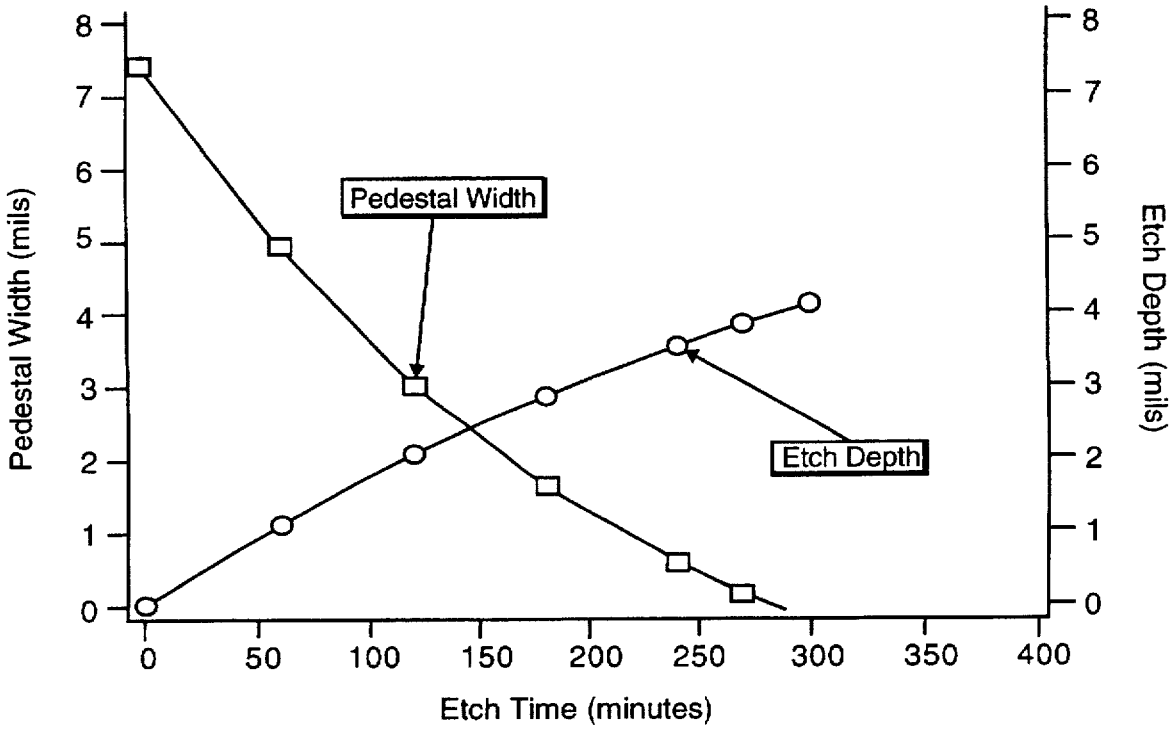
FIG. 3 is a representation ETCHANT CHARACTERIZATION CURVE.

The FIG. 3 ETCHANT CHARACTERIZATION CURVE consists of two curves. One is the pedestal for the barriers or walls after the lapse of a given etch time. The other is the etch depth for the channels after the lapse of a given etch time. The FIG. 3 is based on the following data:

| Etch time (min.) | Pedestal width (mil) | Etch depth (mil) |
|---|---|---|
| 0 | 7.5 | 0 |
| 60 | 4.5 | 1.14 |
| 120 | 3.5 | 2.13 |
| 180 | 1.5 | 2.72 |
| 240 | 0.5 | 3.5 |
| 270 | 0 | 3.98 |
| 300 | 0 | 4 |

SUBSTRATES 10 AND 20

In the best embodiment of this invention, the substrate plates 10 and 20 are of a soda lime silica glass composition typically comprising about 73 percent by weight silica, about 14 percent by weight soda, and about 13 percent by weight calcia. The working surface of the plate, i.e., the surface on which the electrodes and dielectric are deposited, should be flat and free of defects such as scratches, chips, or other blemishes.

It has been found that maximum surface flatness and minimum surface defects are obtained in a soda lime silica glass manufactured by a so-called float glass process; i.e., a glass prepared by floating a molten sheet of glass over a hot molten metal surface, typically molten tin. Such a process is well known in the glass art and is illustrated by U.S. Pat. Nos. 3,826,637; 3,843,344; and 3,850,787.

In another embodiment, the substrate is of a ceramic or ceramic-like material containing one or more oxides such as aluminum oxide, silicon oxide, titanium oxide, zirconium oxide, magnesium oxide, lead oxide, and so forth.

The glass substrate is cleaned prior to use. Such cleaning may include chemical treatment such as degreasing with selected solvents. Any cleaning process may also include scrubbing with a detergent, rinsing with deionized (DI) water, and drying. Another substrate cleaning process comprises ionic bombardment in a wet active gas as disclosed by U.S. Pat. No. 3,868,271. Another substrate cleaning process comprises ultrasonic cleaning where the substrate is emersed in a suitable liquid medium such as degreasing solvents, DI water with or without detergent, or other liquids and subjected to ultrasonic waves.

After heating and cooling cycles, a glass substrate may be found to have expanded or contracted. This movement of the glass is especially noticeable after high temperature heating and cooling cycles such as in the firing and curing of the thick film base dielectric and during the burn-out of organic vehicles and solvents from the dielectric and/or phosphor. This movement of the glass may cause alignment problems with artwork or masks, particularly during the various multiple photolithography processes. This glass movement may be uniform or non-uniform and may interfere with the accurate formation and registration of the barriers and phosphor geometry relative to the electrodes. Glass movement, whether uniform or non-uniform, may cause the electrode pitch to change. Further, delamination or stress cracks may occur between subsequent dielectric layerings.

It has been discovered that the movement of the glass substrate through expansion and contraction can be reduced and minimized by preheating the glass substrate to above its annealing temperature and slowly cooling. For soda lime glass, the annealing temperature is above 1000 degrees F. The glass substrate is maintained at its annealing temperature for a period of time sufficient to relieve stresses. Typically, this period of time is at least 15 minutes and may be several hours. In the extreme, the glass could be held at or above its annealing temperature for hundreds of hours or more.

The glass is cooled at a slow rate in order to minimize or prevent the build-up of stresses. Typically, this cooling rate is about −0.5 deg F. to −2 deg F. per minute.

This preheating and slow cooling of the glass is typically done before the deposition of the electrodes. The end result of this preheating and slow cooling is to relieve stresses and stabilize the glass such that movement of the glass through expansion and contraction during subsequent heating and cooling cycles is greatly reduced. It is believed that the preheating and slow cooling shrinks or compacts the glass and increases its density. Multiple cycles, i.e. at least two or more, of preheating and slow cooling may be used.

Although the above applies to glass, it may also be applicable to other materials including certain ceramics.

ARRAY OF ELECTRODES OR CONDUCTORS 12 AND 21

The electrodes or conductors in arrays 12 and 21 may be applied by any suitable means including thick film and/or thin film techniques. Typical thick film techniques include screen printing through a stencil or screen. Typical thin film techniques include sputtering, resistive heating, electron beam deposition, and chemical vapor deposition.

The arrays of electrodes or conductors 12 and 21 may be applied to the substrate in any selected pattern. Typically the electrode patten is an array of parallel metal conductors. These electrodes, at least on the viewing side substrate, may be split or divided with windows or openings such as disclosed in U.S. Pat. No. 3,701,184 to Grier.

The electrodes may be constructed out of any suitable electrically conductive material such as a pure metal, metal alloy or metal compound of silver, gold, platinum, aluminum, magnesium, zinc, titanium, tantalum, indium, zirconium, nickel, tin, tungsten, chromium, copper, hafnium, gallium, cadmium, niobium, ruthenium, and so forth. Laminates of pure metals and alloys may also be used.

Specific alloys include gold-platinum, gold-aluminum, gold-silver, copper-silver, copper-chromium, and so forth.

In one best mode of this invention, the electrodes are a chromium-copper-chromium laminate applied to the substrate by a thin film process of the types described above. Reference is also made to U.S Pat. No. 3,837,724.

In another best mode of this invention, the electrodes are of near pure gold. Since gold does not readily adhere to soda lime glass, a thin layer of tantalum or other substance may first be applied to the glass substrate in order to provide an adhering interface for the gold.

In one best embodiment, the electrodes are of 99.99% by weight gold deposited to a depth or thickness of about 5,000 to about 25,000 angstrom units over a layer of tantalum deposited on the substrate to a depth or thickness of about 100 to about 500 angstrom units.

As used herein, 10,000 angstrom units equal one (1) micron. One (1) mil is 0.001 inch and equals 25.4 microns or 254,000 angstrom units.

In another embodiment, the electrodes are of a transparent material such as indium-tin oxide. In this embodiment, the transparent electrodes may also carry or contain a highly electrically conductive metal or alloy such as gold, nickel, or chrome-copper-chrome. This electrically conductive material may serve as an auxiliary electrode to increase or maintain electrical conductivity along the length of the transparent electrode. In order to maintain transparency, the auxiliary conductive electrode is narrow relative to the width of the transparent electrode. The auxiliary electrode should also be positioned so as to minimize interference with the light output.

CONNECTING ELECTRODES OR PADS P

The electrodes inside the gas chamber are typically extended through the perimeter seal for terminal connections outside of the gas chamber. Connectors, pads or connecting electrodes P are provided on the perimeter of the panel outside of the gas discharge area. These can be thick film or thin film electrodes. In the best embodiment, the connecting electrodes are extending fingers composed of thick film gold mixed in a glass frit deposited on the substrate with a stencil or screen and fired (heated) at an elevated temperature sufficient to cause the frit and gold to adhere to the substrate.

BASE DIELECTRIC 19, 22

The base dielectric 19 (and 22) may be applied over the electrode arrays 12 and 21 by any suitable means including both thick film and thin film techniques. Typical thick film techniques include screen printing, dry film applications, spraying, roller coating, dip coating, blade coating, and spin coating. Typical thin film techniques include thin film deposition processes such as sputtering, resistive heating, electron beam deposition, and chemical vapor deposition.

In one best embodiment contemplated for the practice of this invention, the base dielectric is a thick film of lead borosilicate applied by screen printing. In this embodiment, after electrode pattern generation on the substrate, a uniform layer of thick film base dielectric is applied by one or more screen printing(s) over the electrodes.

The total thickness of the base dielectric is about 0.5 to 11 mils, typically about 1 to 6 mils. A mil is defined as 0.001 inch (one thousandth of an inch). Each layer of dielectric build-up is applied to a thickness of about 0.25 to about 0.7 mil.

The base dielectric 19 on the bottom substrate and/or the base dielectric 22 on the top substrate may contain or carry one or more phosphor materials. Such phosphor may be electroluminescent and/or photoluminescent.

WORKING EXAMPLE FOR APPLICATION OF BASE DIELECTRIC

The thick film base dielectric layer is preferably comprised of at least two separate layers, a first layer and a second layer. The first layer is printed to a thickness of about 0.5 mils (12.7 microns). This first dielectric layer is flowed at 1100 degrees Fahrenheit (F.) plateau temperature for 15 hours. For groove, channel or trough formations, after the first dielectric layer has been heated and flowed, the second dielectric layer is applied with and formed by one or more subsequent dielectric layers being printed over the first dielectric layer to achieve a total after firing dielectric thickness of about 3.6 mils (91.4 microns).

The following thermal cycle is employed to flow the first and second dielectric layers.

| Beginning Set Point (Degrees F.) | Ending Set Point (Degrees F.) | Ramp Rate (Degrees F./Min) | Total Time |
|---|---|---|---|
| 75 | 1,100 | +3 | 5.83 hrs. |
| 1,100 | 1,100 | 0 | 15.00 hrs. |
| 1,100 | 75 | −1.25 | 14.00 hrs. |

The second dielectric layer is achieved via multiple screen printing of multiple layers. After each print, the substrate is removed from the printer, dried, and rotated 90 degrees. This print-dry-rotate technique helps achieve a more uniform dielectric layer after firing. This second dielectric layer is flowed at the same above cycle as the first layer. It is on this second dielectric layer that the grooves, channels or troughs and barriers are generated.

The second dielectric layer is applied on a smaller area (the display region DR) than the first dielectric area. The reason for this is to eliminate the need to etch the second dielectric in the seal flow area or transition corridor. See FIG. 1C.

After the second dielectric layer has been flowed, the dielectric thickness is measured at the outer frontiers of the second dielectric layer using a Zeiss Light Section Microscope. This will reveal the profile of the second dielectric layer thickness in the transition or seal corridor SC surrounding the outer perimeter of the second dielectric layer. The thickness of the dielectric will decrease, from the inside to the outside of the transition or seal corridor SC. In this example, the width of this transition or seal corridor is approximately 150 mils.

If the second dielectric layer has to be flowed twice (in the case of an additional print requirement), then the width of the transition corridor is usually closer to 350 mils. The width of the transition corridor must be measured for each substrate or each batch of substrates in order to determine how far into the second dielectric the layer acrylic coat (discussed below) needs to be applied.

For all layers, a slow dielectric cooling (ramp down) of about −0.5 to −2 degrees F. per minute to cool the dielectric from the dielectric cure or set point anneals the glass substrate and reduces glass substrate movement through expansion or contraction. For lead borosilicate dielectric, the set point is about 1,075 to 1,150 degrees F.

COMPOSITION OF THICK FILM BASE DIELECTRIC

The dielectric composition may be vitreous or vitrified such as a glass. It may also be a devitrified composition such as a crystal, typically a poly-crystalline material.

The thick film dielectric must be chemically compatible with the selected electrode material, typically gold in one best mode of this invention, and must have thermal expansion characteristics compatible with the substrates and other components.

In one mode of this invention, the dielectric is a devitrified lead-zinc-borate dielectric glass composition of the type disclosed in Claypoole reissued U.S. Pat. No. 25,791. The ingredients and proportions of this glass composition before devitrification are 65 to 86 percent by weight lead oxide, 5 to 15 percent by weight zinc oxide, 5 to 15 percent by weight boric oxide, 0.5 to 5 percent by weight silicon oxide. Small amounts of other metal oxides such as copper oxide, antimony oxide, etc., may also be present.

This lead-zinc-borate glass composition is made into a very fine (less than 100 mesh) powder and mixed with an organic binder and vehicle to form a slurry or suspension. This slurry or suspension is applied to the substrate as a thick film of dielectric glass over the array of electrodes. The thick film of dielectric glass is then heated and devitrified, using, for example, the thermal cycles disclosed in the above mentioned Claypoole patent, incorporated by reference.

In another mode, there is used a thick film of a non-devitrifiable lead borosilicate glass composition. The ingredients and proportions of this composition are 60 to 80 percent by weight lead oxide, 5 to 30 percent by weight silicon oxide, 0 to 8 percent aluminum oxide, 0 to 10 percent calcium oxide, 0 to 10 percent magnesium oxide, 0 to 10 percent zinc oxide, and 0 to 5 percent alkali metal oxides. Specific examples of such composition, including a method of application, are disclosed in Sherk U.S. Pat. No. 3,917,882 and Sherk, et al., U.S. Pat. No. 3,923,530. Both of these patents are incorporated by reference into this disclosure.

The thick film dielectric of one or both substrates may carry or contain one or more phosphor materials. In such embodiment, the phosphor may be physically mixed with, intimately dispersed with, chemically part of, or otherwise incorporated with or on the dielectric.

GROOVES, CHANNELS OR TROUGHS 25 AND BARRIERS 26

Grooves, channels or troughs 25 are formed in the thick film dielectric of the first substrate with each groove, channel or trough being separated from each adjacent groove, channel or trough by at least one dielectric ribs, wall or barrier 26.

The functions of the dielectric lands, ribs, walls or barriers 26 on the first substrate are to provide optical and/or electrical isolation between adjacent phosphor grooves, channels or troughs, provide spacers and supports for the second substrate to be positioned over the first substrate, and to provide pairs of phosphor bearing surface (e.g. double phosphor stripes) which are outside the areas of phosphor deteriorations due to ion bombardment. Optical and/or electrical isolation between grooves, channels or troughs 25 is required to minimize or prevent photon cross-talk between light emitting phosphors deposited within the grooves, channels or troughs. By also using the dielectric barriers 26 to support the second substrate and maintain it at a given spacing or distance relative to the first substrate, there is eliminated the prior art substrate spacers and the problems associated therewith.

In one best embodiment contemplated for the practice of this invention, there are a plurality of grooves, channels or troughs 25 running parallel with each other and with parallel eletrode array 12-1, 12-2 . . . 12-N on the supporting substrate 11. Each parallel channel 25 is positioned above a parallel electrode 12 as illustrated in FIG. 1A. In another embodiment, the channels 25 are at an angle to the parallel electrode arrays. In either embodiment, the channels 25 have continuous walls or barriers 26 extending across the substrate parallel to or at an angle to the electrodes. The angle of the channels or walls is typically perpendicular (90 degrees) to the electrodes. However, the angle can be less than or greater than 90 degrees. Thus, the electrodes can be zig-zag, serpentine, S-shape, or any other pattern relative to the channels.

In the final assembly of the panel structure, a second substrate 20 with electrodes and dielectric is positioned over the first substrate on top of the continuous walls or barriers of the first substrate. The electrodes of the second substrate 20 are at an angle to the electrodes of the first substrate so as to form electrode crossovers and define a plurality of discrete gas discharge units or cell sites. Typically, the angle of electrodes crossover is orthogonal or perpendicular.

The use of continuous walls, ribs or barriers as spacers and structural supports results in a final panel mechanical structure which is substantially more resistant to shock, vibration, and other forces.

The respective channel for each respective phosphor (red, blue or green) can be etched to a different depth with a different dielectric thickness over the electrode and a different gas discharge gap. This may be accomplished by two or three separate etching operations and/or separate multiple screen printing operations. By varying the channel depth, gas gap, and dielectric thickness for each phosphor, one can make adjustments for any differences in power input and brightness output for each phosphor.

In another embodiment of the invention, the thick film base dielectric comprises two or more layers with at least two layers being of different chemical compositions. For etching, one dielectric layer composition may be more or less resistant to etchant than another dielectric layer composition.

The barriers or walls between the channels can be screen printed and built up one layer at a time. These can be etched or not.

In another embodiment there is used a photosensitive dielectric. In this embodiment a dielectric composition is mixed with a photosensitive material such as a photoresist, screen printed as a uniform coating, exposed to a light source through a mask, developed, and then fired or cured at an elevated temperature. This may be repeated several times before or after the elevated temperature firing or cure to obtain the desired barrier height and geometry. This embodiment is also applicable for the fabrication of conductor connecting pads to the electrode arrays.

The photosensitive dielectric paste may be exposed to UV, x-ray, or other suitable radiation through the rear or bottom side of the substrate 11 so that the non-transparent electrodes function as a mask. This technique can eliminate the need for the alignment of a mask or artwork, i.e. self-alignment.

The total dielectric thickness prior to etching is about 0.5 to 11 mils, typically 1 to 5 mils.

The thickness of the dielectric over each electrode is about 0 to 1 mil, typically 0.2 to 0.6 mil.

The dielectric can be etched through to the electrode and the thin film dielectric (such as the phosphor undercoat) is then deposited over the exposed electrode.

In the preferred practice of this invention, the etched channels have sloping walls, e.g. the angle of the barrier surfaces make relative to the substrate. Phosphor can be more readily deposited on sloping walls than vertical walls. Moreover, within limits, depending on the slope upon which the phosphor is deposited, the light produced can be additive and is more visible.

The phosphor material may be physically or chemically included as part of the dielectric so that the channel walls carry or contain the phosphor.

In order to increase phosphor deposition and light output, the angle ($\alpha$) of each barrier or wall 26 relative to the substrate 11 should be less than 90 deg. This angling or sloping of the barrier or wall 26 increases the surface area available for phosphor deposition so that more phosphor (i.e., a larger quantity) can be deposited. Light output will be increased with more phosphor deposition.

With an angle α of less than 90 deg., the angle of viewing is also increased. Thus, with α less than 90 deg., the light output is enhanced by both an added quantity of deposited phosphor and by an increased viewing angle.

FORMATION OF GROOVES, CHANNELS OR TROUGHS AND BARRIERS

Groove, channel or trough and barrier formation is achieved by wet chemical etching (sometimes called chemical milling) with an etchant mixture of nitric acid, phosphoric acid, a mediating agent, and water (sometimes referred to in the art as "chemical milling"). DI water is preferred.

| | |
|---|---|
| Nitric Acid | 1 to 10 percent by volume |
| Phosphoric Acid | 0.1 to 4 percent by volume |
| Mediating Agent | 20 to 80 percent by volume |
| Water | Remainder |

An etchant characterization curve (FIG. 3) is determined for each fresh batch of etchant. This curve comprises a plot of time versus the etched depth. A companion curve is also determined for the width of the pedestal at the top of the etched walls or barriers.

The function of the nitric acid ($HNO_3$) is to etch the lead borosilicate dielectric glass to form lead nitrate which is a water soluble salt.

The function of the phosphoric acid ($H_3PO_4$) is to etch the lead borosilicate. This has limited solubility and tends to precipitate as a white salt which is redissolved into the nitric acid.

The function of the mediating agent is to partially passivate the dielectric surface and tame and retard the attack of the acids on the dielectric. Examples of suitable mediating agents are polyhydric alcohols which are liquid and soluble in the acids at the temperatures of use. These include dihydric alcohols such as ethylene glycol, trihydric alcohols such as glycerol, and polyols such as polyethylene glycol.

Other acids may be used. For example, fluoroboric acid ($HBF_4$) and hydrogen fluoride (HF) may be used in combination with or substituted for nitric acid. If any fluorine containing acids are used for etching, one must protect the substrate glass with a suitable polymer coating such as acrylic. Other acids such as sulfuric ($H_2SO_4$) and hydrogen chloride (HCl) may be used in combination with or in substitution for the phosphoric acid.

Figure 2:
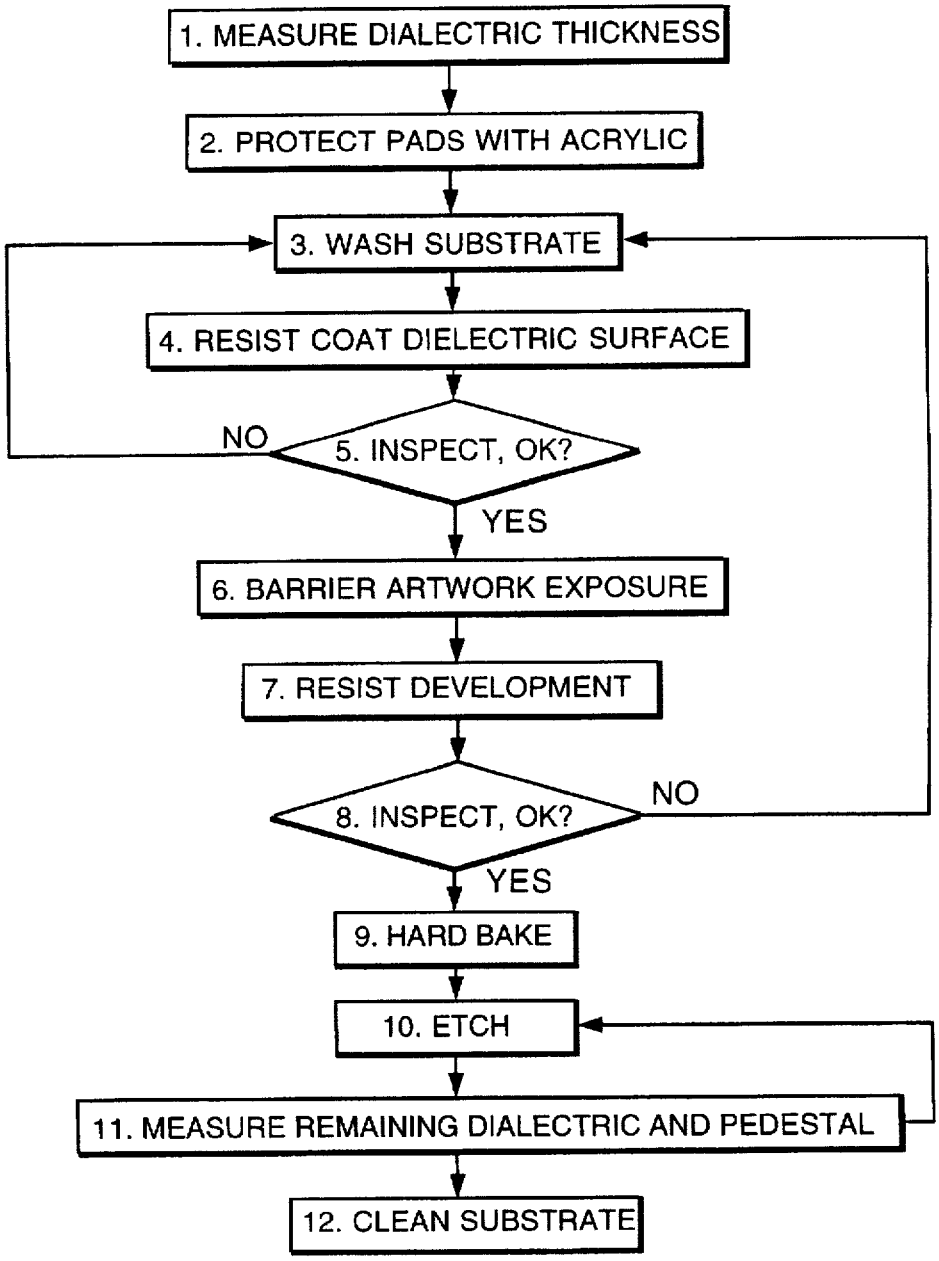
FIG. 2 is a flow diagram for the etching process for forming dielectric channels and barriers. This is discussed hereinafter as part of a working example.

FIG. 2 is a flow diagram for the etching process for forming dielectric grooves, channels or troughs and barriers.

A WORKING EXAMPLE and embodiment of this etching process as illustrated in FIG. 2 is as follows:

WORKING EXAMPLE FOR ETCHING PROCESS

1. Measure Dielectric Thickness

Each substrate prior to etching is first measured to determine total dielectric on the substrate, uniformity of dielectric thickness, what barrier art work line width to utilize and the total etch time required (from FIG. 3 Etchant Characterization Curve). Dielectric thickness is measured using a Zeiss Light Section Microscope and location points noted using an appropriate template. The transition corridor width and location is determined as discussed above. Depending on the amount of remaining dielectric desired, too large a variation on the total dielectric thickness may cause electrodes to be exposed during etching.

2. Protect Pads P and Seal Flow Area with Acrylic

Prior to etching, all substrates' connector pads and seal flow area must be protected from the etchant. A photoresist coat alone on the pads is not enough to protect the pads from the etchant. Since the connector pads are comprised of glass frit and gold, they are subject to dissolution in the etchant. A good way to protect the pads is to spray a coat of clear acrylic on them. However, the transition corridor width and location is first determined.

Then the entire center area of the substrate is masked off with a double layer of aluminum foil, leaving exposed all the pads, seal flow areas, and a 2 mm rectangular border, on the second dielectric layer, adjacent to the outer edge of the transition corridor. This use of the aluminum foil is for masking and protection of the dielectric from the acrylic.

It is important not to get any acrylic on the active area of the substrate and thus the reason for using a double layer of aluminum foil. The foil is taped down at the top, bottom, left and right of the substrate with a low adhesion tape. This tape should run perpendicular to the electrodes at the top and bottom of the substrate and parallel to the electrodes at the left and right edges of the substrate. A smooth, straight edge, wrinkle free, tape adhesion is formed on the dielectric surface and the tape is gently cut at the four corners with a sharp blade. The area to be sprayed with acrylic is then carefully blown with compressed air and/or wiped clear of any dust, lint or finger grease.

In a smooth, continuous fashion, the acrylic is sprayed on the pads, one coat at a time, a total of at least three times, with a 10 minute dry time between each coat. The spraying and drying is performed in a ventilated hood and the final coat is dried for at least 30 minutes. The coats are then inspected carefully for pin holes and exposed areas. If necessary, more acrylic coats are sprayed. Then, the tape is gently peeled off, taking care not to rip the acrylic layer and the foil is removed. Active area is inspected for any acrylic droplets which if found, must be removed with organic strippers, specifically 1-methyl-2-pyrolidinone and acetone. Care is taken not to drop any acetone or 1-methyl-2-pyrolidinone on the "good" acrylic coat as this could ruin the coat and expose the connector pads. Depending on how much and where the acrylic droplets are, the whole substrate may have to be cleaned of acrylic and the whole coating process repeated.

Low adhesion tape has also been used (in place of acrylic coating) to protect the thick film pads during any universal etching (that is etching the entire dielectric surface to reduce the total dielectric thickness in the event the measured dielectric thickness is too thick). This procedure involves placing the tape down on all areas that are to be protected from the etchant while the substrate is immersed in etchant. Tape may also be used to protect pads during barrier etching.

3. Wash Substrate

After the acrylic coating and just prior to photoresist coating the dielectric surface, the substrate needs to be free of dust, finger grease and moisture. Depending on how dirty the substrate is, it may be:

(i) Wiped clean with a gauze pad soaked in isopropanol, then washed with running deionized (DI) water, and blown dry with filtered dry air or nitrogen.

(ii) Wiped clean with a gauze pad soaked in 1-methyl-2-pyrrolidinone, then a gauze pad soaked in iso-propanol, then washed with running deionized water, and blown dry with filtered dry air or nitrogen.

4. Photoresist Coat Dielectric Surface

The following step is to coat the entire dielectric surface with positive photoresist. This is typically performed using a Zicon photoresist sprayer.

The following points are noted:

(i) Substrate cleanliness and dryness are absolutely critical to the quality of the photoresist coat.

(ii) Overcure (IR soft bake) of the positive photoresist reduces its photosensitivity, thus requiring much longer exposure.

(iii) Fine pin-hole problems in the photoresist coat may be solved by:

a) Allowing the substrate to air dry for 20 minutes in a Zicon spray chamber prior to forced air drying and subsequent IR (infra-red) curing of the photoresist in a conveyerized IR oven.

b) Double spraying the photoresist, i.e. spraying two "thinner" coats rather than one "thicker" coat. This may change the subsequent exposure and development times.

c) Proper cleaning and drying of substrate prior to photoresist coating.

(iv) The dielectric glass absorbs IR and heats up the substrate and cures the photoresist. The more dielectric there is on the substrate, the more the cure of the photoresist coat provided that everything else remains the same.

Photoresist on substrates with gold electrodes may be "less cured" compared to a blank substrate with the same dielectric thickness because the gold may reflect IR radiation.

5. Inspect

After photoresist coat and soft bake, the layer is inspected in yellow light for pin-holes, openings, non-uniformity and other anomalies. If it is satisfactory, barrier art work exposure is done. If the photoresist coat is poor, it is stripped off by:

i) Exposing the entire photoresist coat to UV light (3 minutes using a 6 kW lamp at 50 inches).

ii) Developing the photoresist off by immersing it in aqueous sodium hydroxide (NaOH) developer for two minutes at 90 degrees F.

iii) Washing thoroughly with water and blowing it dry, taking caution not to damage the acrylic coat on the pads.

iv) If there are stubborn areas of photoresist that do not develop off, these are removed by wiping with a cotton bud soaked in 1-methyl-2-pyrrolidinone, taking care not to ruin the acrylic coat on the pads. If the acrylic coat gets affected by the cleaning process, the acrylic coat will have to be stripped and reapplied. See Step 2 above.

6. Groove, Channel or Trough and Barrier Art Work Exposure

Following inspection, the barrier pattern is generated on the photoresist by aligning the appropriate barrier art work to the substrate, exposing it to UV light and then developing the photoresist. The appropriate art work is selected based on the etch depth and rib or barrier width required and the growth/shrinkage of the glass substrate.

The barrier photomasks are made of Mylar plastic or glass. Mylar art work tends to be dimensionally unstable in varying temperature and humidity environments. As such, each piece of Mylar art work needs to be measured and characterized for its shape, i.e., whether it is barrel, hour-glass, trapezoidal or rectangular in shape. Glass substrates also exhibit non-uniform growth/shrinkage after the high temperature dielectric flow cycles. As such, each substrate needs to be measured and characterized for its shape, i.e., whether it is barrel, hour-glass, trapezoidal or rectangular in shape. The art work must then be matched appropriately to the substrate in order to minimize the misalignment.

The art work is taped on the inner side of the clear glass on an alignment table, emulsion side facing down. The substrate is placed on a rubber mat, photoresist side facing up and the art work is brought to contact with the photoresist surface. Alignment is accomplished via the use of the microscopes and monitors in conjunction with the motorized positioning table that moves the substrate in the x, y and theta directions. A yellow filter is used at the microscope lamp source when illuminating the art work/substrate during alignment. Unfiltered light will expose the photoresist, causing imaging problems. Once alignment is accomplished, a vacuum is applied to bring the substrate in full contact with the art work. The substrate is exposed to UV light from an overhead 6 kW UV lamp at a distance of 50 inches. For the current process 50 inch distance, 6 kW lamp, 6.0 to 6.5 mil line width for barrier art work and immersion development, single coat photoresist, an exposure of 2 minutes is appropriate. Exposure time may need to be varied depending on photoresist thickness.

7. Photoresist Development

After exposure, the photoresist is developed in aqueous 5 percent by weight NaOH developer for 60 seconds at 90 degrees F. Again, the actual development time can vary for different photoresist thickness and developer strengtplacee substrate is placed in an appropriate frame, and immersed into a recirculating tank containing the developer. After development, the substrate is washed in DI water, blown dry with compressed air and inspected carefully.

8. Inspect

The barrier pattern generated on the substrate is inspected for pin-holes, bridges, scumming, breaks in pattern lines, completion of development, non-uniformity and line width of pattern. All the above need to be looked at carefully. An incompletely developed part will not uniformly etch. If the pattern generated is unsatisfactory, the photoresist is stripped off and the substrate is recoated with photoresist. See Step 5, iii above for cleaning procedures.

9. Hard Bake

If the barrier photoresist pattern on the photoresist is satisfactory, the photoresist is further cured in a convection oven at 220 degrees F. for one hour. This serves to improve adhesion between the photoresist and the dielectric surface.

10. Etch

Rib or barrier generation is achieved by wet chemical etching. Various acids are known to etch the lead borosilicate dielectric glass on the substrate. In this process, the following etchant composition in by volume percentages is used:

| | |
|---|---|
| Nitric Acid | 5.0% (2.75 liters of 70% by volume HNO3) |
| Phosphoric Acid | 0.5% (0.275 liters of 85% by volume H3PO4) |
| Glycerol | 66.7% (36.685 liters of 99.5% by volume Natural Glycerin) |
| Deionized Water | 27.8% (15.29 liters of DI water) |

A typical batch of etchant of 55 liters will contain the above quantities of material.

A fresh batch of the above will typically be used to etch about fourteen, 19-inch diagonal size substrates or used for about one month, whichever comes first. After about fourteen substrates have been etched, the etchant becomes weak and its etch rate decreases. After about a month, bubbles begin to develop in the tank, due to the breakdown of the acids.

When each fresh batch of etchant is mixed, it must first be characterized for its strength. A blank test substrate with the appropriate photoresist patterning on the dielectric is etched at the appropriate agitation rate. The test substrate is removed from the etch tank at various time intervals, washed, dried, and different segments of the test panel are sprayed with a clear coat of acrylic to inhibit further etchant. After about 4 to 6 etch-wash-spray cycles, the entire test substrate is stripped of all photoresist and acrylic on its surface using 1-methyl-2-pyrrolidinone. The part is then washed, dried and measured for etch depth and pedestal line width at the various etch times.

After the hard bake, the substrate is allowed to cool to room temperature prior to etching. Etching is accomplished by moving the substrate up and down within the volume of the etchant. The substrate is oriented such that the barrier (photoresist pattern) is parallel to the movement direction, i.e., up-down. Total etch time must first be determined from the Etchant Characterization Curve (FIG. 3). The substrate should be rotated 180 degrees every 30 minutes during the total etch time. After the total etch time, the substrate is removed from the etchant and gently washed in room temperature DI water and dried in a hood. The photoresist at this point is extremely fragile.

11. Measure Remaining Dielectric and Pedestal

When the substrate is dry, the remaining dielectric on the substrate is measured. If it is still too much, etching is continued until the desired thickness of about 0.4 mils is achieved.

12. Clean Substrate

After etching, the substrate is washed in DI water, fresh 1-methyl-2-pyrrolidinone and more DI water. The substrate is blown dry, and inspected for cleanliness under the microscope. At this point, further profile and thickness measurements are performed on the substrate.

GENERAL CONCEPTS FOR ETCHING i) The higher the glycerol content (compensated by reducing the water), the slower the etch rate, but the better the photoresist adhesion to the substrate.

ii) The higher the water content (compensated by reducing glycerol content), the faster the etch rate. The photoresist tends to peel away from the dielectric surface in a highly aqueous, unbuffered etchant.

iii) The use of small amounts of phosphoric acid tends to produce more vertically etched channel walls or barriers.

iv) Etchant temperature and agitation rate strongly influences the etch rate.

V) More uniform wall or barrier profiles are obtained when the substrate movement direction in the etchant is up-down, parallel to the barrier trough.

vi) Better control comes with slower etch rate.

PROTECTIVE UNDERCOAT 30

According to the invention, a protective undercoat 30 is applied to the substrate and etched dielectric before the deposition of the phosphor. This undercoat may be continuous or discontinuous and serves as an intermediate layer in-between the dielectric and phosphor. The purpose of the undercoat is to minimize or prevent the migration of sodium or other ions from the soda lime glass substrate through the dielectric into the phosphor. The undercoat also retards the sinking of phosphor crystals or particles into the dielectric.

Undercoats which may be used include oxides of aluminum, magnesium, calcium, strontium, barium, silicon, titanium, zirconium, hafnium, lead, gallium, indium, thallium, vanadium, niobium, scandium, and the rare earths, especially, lanthanum, cerium, actinium, and thorium. In addition to the oxides, other inorganic compounds may also be used, including halides, nitrides, carbides, borides, sulfides, and silicates of the above elements.

Multiple protective undercoats may also be used, especially dual oxides such as oxides of magnesium and aluminum; magnesium and silicon; aluminum and silicon; and others.

The thickness of the protective undercoat ranges from about 200 to about 20,000 angstrom units.

Although the undercoat may be applied by thick film or thin film techniques, thin film processes are preferred. The thin film deposition processes include electron beam deposition, sputtering, chemical vapor deposition, and resistive heating.

In one best embodiment, a protective thin film undercoat of alumina is applied by electron beam deposition to the surface of etched dielectric and substrate. The thickness of the alumina is about 8,000 to 9,000 angstrom units. The alumina undercoat retards the sinking of subsequently deposited phosphor particles or crystals into the dielectric surface and enhances the resulting light output of the display.

In some embodiments and applications, it may be appropriate not to use the protective undercoat 30. This may be an option where the dielectric 19, 22 contains or carries one or more phosphors and/or where one or more phosphors is applied only on the top substrate as part of or on the dielectric 22.

PHOSPHOR STRIPE 32 APPLICATION

Phosphors are applied with negative or positive photoresist using a combination of wet chemistry and photolithographic techniques. Examples of suitable photoresist are disclosed in U.S. Pat. Nos: 2,956,878 and 3,674,745.

Figure 4:
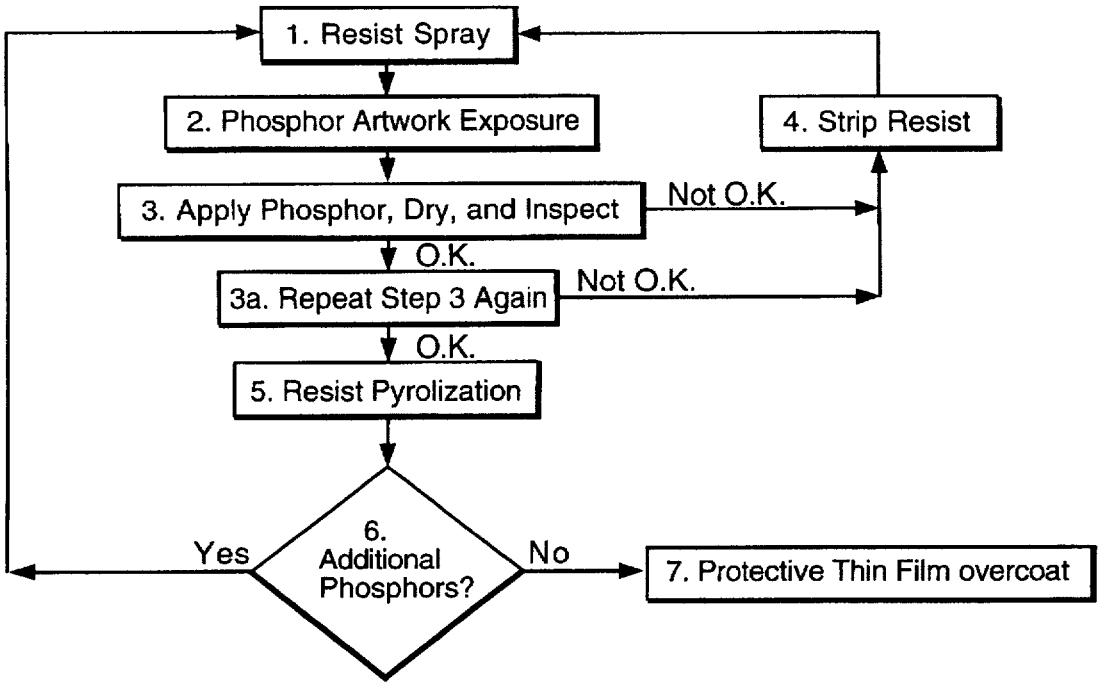
FIG. 4 is a flow diagram for the PHOSPHOR APPLICATION PROCESS. This is discussed hereinafter as part of a working example.

The flow chart in FIG. 4 illustrates the process for applying green, red, and blue phosphors onto the etched first substrate.

A WORKING EXAMPLE and embodiment of this phosphor application process as illustrated in FIG. 4 is as follows.

WORKING EXAMPLE FOR PHOSPHOR APPLICATION PROCESS

1. Photoresist Spray

The first step for the applying of phosphors onto the substrate is to spray coat the etched surface of the substrate with a negative photoresist. The photoresist is used without any dilution. The photoresist coat is cured in an infra-red oven.

Changes in humidity during photoresist coating may affect quality and the density of the applied phosphor. Best results are obtained when humidity is below 60 percent (set RH at 50 percent). Temperature should be 60 to 65 degrees F.

2. Phosphor Art Work Exposure

After IR curing the substrate is placed in an oven at 120 degrees F. for storage. The substrate is allowed to cool to room temperature before alignment procedure.

The phosphor stripe pattern is imaged on the photoresist surface by aligning the phosphor art work to the substrate and exposing it to UV for a predetermined duration (230 seconds for Green, 100 seconds for Red, and 100 seconds for Blue). Vacuum is applied at the alignment table to ensure intimate contact between the art work and the photoresist surface. The emulsion side of the art work should face the photoresist surface. For more on alignment techniques, see Step 6 of the WORKING EXAMPLE ETCHING PROCESS.

3. Apply Phosphor, Dry and Inspect

After exposure, the substrate is allowed to cool to room temperature. Next, a slurry of phosphors and organic solvents is poured on the exposed photoresist surface and allowed to settle for a predetermined time in an enclosed chamber, after which the substrate is submerged and agitated in a tub of water to allow the excess phosphors to wash off. The water rinses are continued until the phosphor pattern is clearly evident on the photoresist surface. Any water droplets on the photoresist surface should be free of phosphor particles; otherwise "spot-marks" will appear when the water dries off. The use of a surfactant such as a detergent helps eliminate the formation of "spot marks".

The surfactant is added to the DI water during washing and rinsing. The function of the surfactant is to reduce the surface tension of the water. One surfactant used in the best embodiment is an aqueous mixture of 37 percent by weight ethylene glycol, and 25 to 30 percent by weight p-tertiary-octylphenoxy polyethyl alcohol, with the remainder being water.

After the final rinse, the substrate is propped vertically and gently blown dry with a hot air gun held at about 7-inches away from the phosphor surface. Care must be exercised so as not to form hot spots which can crack the substrate. Upon drying, the phosphor line alignment is inspected with respect to the electrodes using a microscope.

After applying the first color phosphor, Step 3 of the above flow chart is repeated, that is, another batch of the same phosphor slurry is applied to the photoresist surface and allowed to settle for the same duration. Processing is continued as described in above paragraphs 1 and 2 of Step 3.

4. Strip Photoresist

If misalignment is too severe or the phosphor lines are not uniform, the entire photoresist/phosphor coat will have to be stripped with an organic solvent or stripper such as 1-methyl-2-pyrrolidinone, and the process repeated from Step 1. Stripping the photoresist involves soaking the substrate overnight in a tray of the organic solvent, and gently rubbing off the photoresist with a gauze pad soaked in the organic solvent. The part is then washed with fresh solvent and DI water, dried, and inspected.

5. Photoresist Pyrolization

Following a phosphor application, the photoresist coat is pyrolized off in a high temperature batch oven. The following cycle is employed.

| Beginning Set Point (Degrees F.) | Ending Set (Degrees F.) | Ramp Rate Point (Degrees F./min.) | Time |
|---|---|---|---|
| 75 | 630 | +8.04 | 69 min. |
| 630 | 630 | 0 | 60 min. |
| 630 | 780 | +3.95 | 38 min. |
| 780 | 780 | 0 | 60 min. |
| 780 | 860 | +1.00 | 80 min. |
| 860 | 860 | 0 | 6.0 hrs. |
| 860 | 780 | −1.00 | 80 min. |
| 780 | 780 | 0 | 15 min. |
| 780 | 300* | −1.14 | 7.0 hrs. |

*Oven door usually opened slightly at 300 degrees F. to enhance cooling.

Air and oxygen is used during the pyrolization cycle in the following flow rates.

Air at 75 cubic feet per hour.

oxygen at 75 cubic feet per hour.

The above flow rates apply to a Gruenberg oven (Model B120C30.1, 460V Phase 3, 30 Kw input) currently being used.

6. Additional Phosphors

Following the photoresist pyrolization, additional phosphor lines (of the other primary colors) are applied by repeating Steps 1 through 5. Normally, for a full-color display, green, red and blue phosphors are applied, in that order. Note that the final photoresist pyrolization is performed just prior to the deposition of the thin film MgO overcoat 40. This is to ensure that the phosphors do not have a chance to absorb moisture or other contaminants from the atmosphere. However, for process scheduling purposes, the substrate, upon final pyrolization, may be stored in an organics free vacuum oven at 200 degrees F.

The following slurry recipe applies for a 19-in diagonal 127 lines per linear inch substrate.

| | Green Phosphor | Red Phosphor | Blue Phosphor |
|---|---|---|---|
| Phosphor (grams) | 45 | 150 | 81 |
| Isopropanol (milliliters) | 270 | 810 | 405 |
| MIBK (milliliters) | 22.5 | 21.6 | 16.2 |
| Glycerol (grams) | 3 | 216 | 162 |
| Acetone (milliliters) | 4.5 | — | — |
| Settling time (minutes) | 15 | 20 | 20 |
| UV exposure (seconds) (6kW at 50 inches) | 180–200 | 100–120 | 100–120 |

The organic solvent used above as the stripper is acetone and/or 1-methyl-2-pyrrolidinone.

The MIBK above is methyl isobutyl ketone. The function of the MIBK and acetone is to soften the photoresist. Other softeners include other ketones and acetates such as 2-methoxy ethyl acetate and 2-ethoxy ethyl acetate.

OTHER PHOSPHOR DEPOSITION PROCESSES

In addition to the above phosphor deposition, one may "sandblast" the phosphor onto the substrate. This is done by mechanically applying dry phosphor to an imaged adhesive photoresist. The phosphor sticks to the photoresist. Excess phosphor is blown off with air and the photoresist is then pyrolyzed.

As illustrated above, the phosphor is applied by a photographic technique, each phosphor (red, blue, green) typically being applied in a separate step. Such photographic processes are known in the art. Examples of such processes for depositing phosphor particles on a glass substrate are disclosed in U.S. Pat. Nos. 3,856,525; 3,406,068; and 2,920,959.

The phosphor can also be applied to the glass substrate by a screen stencil process as disclosed for example in U.S. Pat. No. 2,625,724.

In one embodiment of the screen process, as disclosed in U.S. Pat. No. 3,753,759, a solvent or vehicle suspension of phosphor is applied through the screen stencil to the surface of a glass substrate. The vehicle or solvent is then removed by heating and drying, leaving the phosphor deposited on the substrate. The phosphor is then fixed to the surface with a coating of a suitable adhesive which will not adversely affect the operation of the device. An example of such a process is disclosed in U.S. Pat. No. 2,797,172.

In another suitable process for applying the phosphor bars, a tacky or adhesive material is first applied to the glass in the desired phosphor pattern by a screen or other printing process. Phosphor particles are then dusted over the tacky glass surface. This sequence is repeated once for each phosphor. The glass envelope or substrate is then heated for a short period of time to evaporate the solvents in the tacky material and bond the phosphors.

As shown in FIGS. 1A, and 1B, the phosphors are deposited along the walls or barriers of the channels. The deposited phosphor does not cover the substrate or dielectric area above the electrode. Thus, the phosphor is not in line or contact with the gas discharge, and hence is not deteriorated due to ion bombardment, but is exposed to the ultraviolet radiation emitted by the discharge, as discussed earlier herein.

In another embodiment of this invention, the phosphor is applied on the walls and bottom of the channel. In such embodiment, the phosphor is on or in the dielectric above the electrode 12. If the phosphor is intimately mixed with or is chemically part of the dielectric 19, the phosphor-dielectric composition 19 serves the dual function of both phosphor and dielectric.

The phosphor can also be physically and/or chemically part of the dielectric 22 on the top plate.

When the dielectric and phosphor are physically mixed and/or chemically the same, the protective undercoat 30 may be applied as a thin film or thick film layer beneath the dielectric/phosphor composition. Such protective undercoat may be continuous or discontinuous.

In another embodiment, the phosphor is applied by a thin film deposition process such as sputtering, resistive heating, electron beam deposition, and chemical vapor deposition.

In another embodiment, one or more phosphors is physically or chemically mixed with thin-film or thick-film dielectric composition and applied to the substrate by means of a thin-film or thick-film deposition process as discussed hereinabove.

In another embodiment, there is used a thin-film or thick-film dielectric composition which has luminescent properties including photoluminescent and/or electroluminescent. In this embodiment, the dielectric gives off visible light when subjected to photons and/or electric field.

COMPOSITION OF PHOSPHORS

Each photoluminescent phosphor is of a phosphor material which is excited by photons, typically ultraviolet radiation with a wavelength of about 500 to about 4,000 angstroms. The phosphor upon excitation emits radiation in the visible light spectrum such as in the red, blue, or green region. A monochrome version of this color display structure is provided by using "all of one color" phosphor stripes. Note that a black and white monochrome version of this color display structure is provided by using white phosphor stripes wherein the white phosphor is comprised of an appropriate mix of primary colored (red, green and blue) phosphors. In certain non-direct view applications one may use phosphors which do not emit light in the visible spectrum. In bright or direct sunlight, a highly efficient phosphor such as green, which can yield 200 foot lamberts pixel brightness, can be applied in a sunlight readable monochrome gray scale display.

The selected phosphors should be free of all impurities. Efficiency and brightness falls off very fast as contaminants begin to appear.

The photoluminescent phosphor is typically an inorganic material. Organic materials can be used providing such do not break down during the heat cycle of the device manufacture or during the operation of the device.

A wide range of inorganic phosphor materials are used. Such materials include oxides, halides, silicates, borates, sulfides, titanates, phosphates, halophosphates, tungstates, arsenates, germanates, vanadates, of zinc, silver, cadmium, silicon, indium, tellurium, thallium, gallium, magnesium, strontium, calcium, barium, thorium, scandium, yttrium, vanadium, and the Lanthanide Series rare earth elements.

Such phosphors are generally self-activated or doped with small activating amounts of zinc, calcium, magnesium, manganese, scadmium, yttrium, silver, tin, uranium, nickel, cadmium, copper, thallium, tellurium, lead, antimony, thorium, and the Lanthanide rare earths, especially europium, terbium, cerium, samarium, praseodymium, erbium, dysprosium, holmium, thulium, and ytterbium.

Some specific examples of phosphors which emit red visible light include magnesium germanum activated with divalent manganese; magnesium fluorogermanate activated with divalent manganese; aluminum oxide activated with rhodium; aluminum oxide activated with chromium; zinc cadmium sulfide activated with copper or silver; cadmium borate activated with divalent manganese; magnesium titanate activated with divalent mananese; calcium orthophosphate activated with tin in the stannous state and zinc selenide or zinc cadmium selenide activated with copper.

Specific phosphors which emit blue visible light include a host matrix of strontium phosphate activated with ytterbium; zinc sulfide activated with zinc or silver; calcium oxide and tungsten oxide activated with lead; and cadmium tungstate activated with uranium.

Specific phosphors which emit green visible light include magnesium gallate activated with divalent manganese; zinc silicate activated with divalent manganese; zinc-cadmium sulfide activated with zinc or silver; and zinc cadmium borate (can be modified with gallium oxide) activated with trivalent terbium.

In the practice of the best embodiment of this invention, the following red, green, and blue photoluminescent phosphors have been used.

| Color Emitted | Description | Formula |
|---|---|---|
| Red | Yittrium Vanadate European Activated | $YVO_4[V]:Eu$ |
| Green | Zinc Silicate Manganese Activated | $Zn_2SiO_4:Mn$ |
| Blue | Barium Magnesium Aluminate European Activated | $BaMg_2Al_{16}O_{27}:Eu$ |

PROTECTIVE OVERCOATS 40

After the deposition of the phosphor, a protective phosphor overcoat 40 is applied over part or all of the substrate surface including the dielectric, barrier walls, and phosphor.

In the best embodiment, there is applied a thin film overcoat with a high coefficient of secondary emission. An excellent material is magnesium oxide applied to a thickness of about 150 to 25,000 angstrom units using high energy vacuum deposition, electron beam evaporation, plasma flame, plasma arc spraying, and/or sputtering target techniques.

The presence of this thin film overcoat serves to improve voltage uniformity and increases the life of the discharge device. It also decreases the magnitude of the voltages necessary for operating the device.

In addition, the overcoat protects the phosphor from being deteriorated by the gas discharge and/or contaminated by sputtered material from the discharge.

Other thin film materials include oxides of lead, cesium, and the rare earths. Dual or multiple overcoats of thin film dielectrics may be used. In such modes, the top thin film overcoat is a material of high secondary emission as described above. Each sub-layer of thin film (beneath the top overcoat) can be a material as described for the top overcoat or a different material such as an oxide of aluminum, silicon, zirconium, and titanium. In addition to the metal oxides listed above, thin films of metal halides, nitrides, and carbides are also used.

In one specific embodiment, there is applied magnesium oxide (MgO) to a thickness of 750 to 1,500 angstrom units.

SEALING COMPOSITION

The composition used to seal the substrates (seal 24 in FIG. 1C) together may be a glass or crystalline composition such as disclosed above for the composition of the thick film base dielectric.

In one embodiment there is a seal composition comprising:

| INGREDIENT | WEIGHT PERCENT |
|---|---|
| $S_iO_2$ | 10 to 20 |
| $B_2O_3$ | 10 to 20 |
| $Al_2O_3$ | 5 to 10 |
| PbO | 60 to 70 |
| $Li_2O$ | 1 to 5 |

This composition has a melting temperature of less than 400 degrees C. It is available as product GO17-230 from Schott Glassworks, Landshirt, Germany.

GAS COMPOSITION

The gas composition is a pure gas component or mixture of one or more gas components selected from neon, argon, zenon, krypton, helium, or nitrogen. Other gases such as CO, $CO_2$, and hydrogen are contemplated.

In one best mode of this invention, the gas is 0.2 to 20 percent atoms of xenon and 99.8 to 80 percent atoms of helium, which is rich in ultraviolet (UV) and has good memory properties.

The pressure of the ionizable gaseous medium within the panel ranges from about 0.1 atmosphere to about 2.0 atmospheres where an atmosphere equals 760 millimeters of mercury or 760 torr.

The ionizable gaseous medium may be introduced into the panel through a tubulation after the device has been sealed together. The use of the gas fill tubulation is well known in the literature. In the Baker, et al., U.S. Pat. No. 3,499,167, the tabulation is illustrated as extending perpendicularly through the substrate near the border. In DeVries et al., U.S. Pat. No. 3,862,447 the gas fill tubulation is shown as extending along the perimeter or edge of the panel adjacent to the seal.

The gas fill tubulation may comprise a pure metal, metal alloy, glass, ceramic or a combination of the above.

FABRICATION OF TOP OR FRONT SUBSTRATE 20

In the best contemplated embodiment, the top or front substrate for the panel is fabricated with electrodes 21 and dielectric 22 the same as the bottom or rear substrate except that the top substrate contains no channels, barriers, or phosphors.

In this embodiment, an array of electrodes or conductors 21-1, 21-2 . . . 21-N and border conditioning electrodes 27 are appropriately deposited on the substrate 20 and covered with a dielectric layer 22 and overcoat 45. The deposition of the conductors 21 may be by thick film or thin film techniques or processes (as discussed hereinbefore) followed by appropriate photoetching (also as discussed hereinbefore).

If printed directly through a mask or stencil, such as in a thick film deposition, the electrode photoetching may not be required.

The electrodes on this top substrate may be of the same or different composition as the electrodes on the bottom or rear substrate.

Because in this embodiment, the display is typically viewed through the top or front substrate 20, it may be advantageous to use an electrode composition which is transparent so as to improve/increase the transmission of light to the viewer.

Transparent electrodes are typically made of indium tin oxide (ITO) or tin oxide. These electrodes exhibit substantially increased electrical resistance after one or more repeated high temperature firing cycles. Because ITO or tin oxide has relatively lower conductivity as compared with pure metals or metal alloys, these electrodes may have a substantial voltage drop especially with large displays requiring relatively long electrodes.

Hence, in this embodiment, the use of a highly conductive metal or metal alloy as a auxiliary electrode along and in contact with the ITO or tin oxide electrode will improve the overall electrical conductivity. This highly conductive auxiliary electrode can be applied by thin film or thick film techniques. It may be located on the surface of the ITO or tin oxide electrode or along either edge or underneath the ITO or tin oxide electrode. The width of the auxiliary electrode should be narrow relative to the ITO electrode so as to minimize interference with the transmission of light.

Another possibility is to use a split electrode or an electrode with holes or openings as disclosed in Grier U.S. Pat. No. 3,701,184.

In another embodiment, the top or front substrate 20 also can carry one or more phosphors the same as the opposing bottom substrate. In this embodiment, the phosphor is carried on both substrates.

In still another embodiment, the phosphor is only on the top or bottom substrate and is not located on the other substrate.

In those embodiments where phosphor is on the top substrate, there may or may not be grooves, channels, troughs or barrier walls.

In another embodiment, the display structure comprises a so-called surface discharge display with the discharge occurring between two or more electrodes located on a common substrate. In this embodiment, all of the electrodes may be located on a single substrate in a so-called monolithic structure or there may be dual or parallel substrates with one or more address, write, and/or priming electrodes located on one substrate and sustaining discharge electrodes on an opposing substrate.

In the dual substrate structure, the phosphor may be located on one or both substrates. There may also be isolation barriers or walls located on one or both substrates to minimize electrical and optical crosstalk.

WORKING EXAMPLE FOR ASSEMBLE, TUBE AND SEAL

Panel assembly is performed immediately after the substrates exit the vacuum chamber and/or the organics free vacuum oven and after thin film MgO overcoat.

For panels with a gap of 3.0 mils, there is used cane seal 24 from Schott Glass with a cross section of 0.5×0.6 mm. Canes are placed wide side down (contacting the glass surface), between the rear and front substrates.

Seal flow occurs between the primary dielectric surface of the rear substrate and the dielectric surface of the front substrate.

Seal width after flow is typically 150 to 250 mils wide.

An evacuation hole for the gas filled tube 28 on the rear substrate 10 has the following exemplary dimensions.

| Panel Size | Tube Size | Evac. Hole I. D. |
|---|---|---|
| 9-in. diagonal | 7 mm | 200 mil |
| 19-in. diagonal | 7 mm | 200 mil |

Tube attachment is performed by using a seal frit and a frit lacquer (amyl acetate).

Tube attachment and seal flow is achieved in one thermal cycle which is described below.

| Beginning Set Point (Degrees F.) | Ending Set Point (Degrees F.) | Ramp Rate (Degrees F./min.) | Time |
|---|---|---|---|
| 100 | 100 | 0 | 10 min. |
| 100 | 790 | +4.79 | 2.4 hr. |
| 790 | 790 | 0 | 1.5 hr. |
| 790 | 100 | −0.96 | 12. hr. |

Upon tubing and sealing, the display is stored in the oven at 100 degrees F. until it is to be attached to the gas processor.

WORKING EXAMPLE FOR GAS PROCESS

Upon tube and seal, the panel is gas processed. The gas used is a 2 percent xenon in a helium mixture. Panels are tipped off at a pressure of about 700 torr. Other gas mixtures and pressures may be used.

The following thermal cycle is employed during gas processing.

| Beginning Set Point (Degrees F.) | Ending Set Point (Degrees F.) | Ramp Rate (Degrees F./min.) | Time |
|---|---|---|---|
| 70 | 70 | 0 | 5 min. |
| 70 | 645 | +2.52 | 3.8 hr. |
| 645 | 645 | 0 | 15 min. |
| 645 | 682 | +0.03 | 18.5 min. |
| 682 | 682 | 0 | 40 hr. |
| 682 | 200 | −2.01 | 4 hr. |

While preferred embodiments of the invention have been shown and described, it will be appreciated that various other embodiments, modifications and adaptations of the invention will be readily apparent to those skilled in the art.

What is claimed is:

1. A gas discharge matrix display device comprising:

a first substrate and a first electrode array on a first surface of said first substrate, a first dielectric layer on said first surface and said first electrode array, a second substrate having a second surface and a second electrode array on said second surface, a second dielectric layer on said second surface of said second substrate and said second electrode array, an array of channels formed in one of said dielectric layers, said array of channels corresponding to and aligned with one of said electrode arrays, each channel having channel sidewalls, lands between each channel, respectively, a protective undercoat on said channel sidewalls, a photoluminescent phosphor on said protective undercoat on said channel sidewalls and a protective overcoat on said photoluminescent phosphor such that said phosphor is sandwiched between said undercoat and said overcoat, said channel sidewalls on which said phosphor is placed being outside the path of charged particles produced on discharge and near the site of UV production thereby, a seal region on each of said substrates, respectively, means joining said substrates together at said seal regions with said electrode arrays orthogonally related, said lands maintaining a uniform spacing between said electrode arrays and optically isolating said channels from each other, and a gaseous discharge medium filling said channels.

2. A gas discharge matrix display panel comprising:

a first substrate having a flat surface and a first linear electrode array on aid flat surface, with each electrode in said first linear array having a longitudinal axis, a dielectric layer on said first linear electrode array, means forming an array of channels in said dielectric layer, each channel having a base and a pair of facing sidewalls, each sidewall making an angle to said flat surface, the base of each channel being positioned over and having a longitudinal axis which is aligned with the longitudinal axis of said electrodes in said first linear electrode array, respectively, a thin protective undercoat layer on at least one of said facing sidewalls and the base of said channels, a photoluminescent phosphor layer on said thin protective undercoat on at least one of said facing sidewalls in each said channel, respectively, one or more protective overcoat layers on each said photoluminescent phosphor layer in each said channel, a second substrate and a second linear electrode array on a surface of said second substrate and transverse to said first linear electrode array, dielectric coating means on said second electrode array, a protective overcoat layer on said dielectric coating means, a seal region on each of said substrates, respectively, seal means joining said first substrate to said second substrate at said seal regions, and a gaseous discharge medium filling said channels.

3. The invention defined in claim 2 wherein each phosphor on said channel sidewalls is a continuous strip.

4. The invention defined in claim 1 or claim 2 wherein the phosphor on one channel sidewall emits light of a different color than its next adjacent neighboring channel, respectively.

5. The invention defined in claim 1 wherein the electrodes in said one of said electrode arrays is aligned with said channels are reflective electrodes.

6. The invention defined in claim 2 wherein said protective overcoat layer is transparent and thin and essentially UV transparent.

7. In a gas discharge display panel in which row and column electrode arrays are insulated from the gas by at least one dielectric layer, and a UV responsive phosphor layer is on the said at least one dielectric layer and at least one protective overcoat layer is on the UV responsive phosphor layer, the improvement comprising a protective undercoat layer between said UV responsive phosphor layer and said dielectric layer whereby said UV responsive phosphor layer is sandwiched between said protective undercoat and said protective overcoat.

8. The invention defined in claim 7 including channels having channel sidewalls formed in said at least one dielectric layer and wherein said phosphor is on said channel sidewalls.

9. The invention defined in claim 7 wherein said protective overcoat layer is transparent and thin and essentially UV transparent.

10. The invention defined in claim 8 wherein each phosphor on said channel sidewalls is a continuous strip.

* * * * *